US007654300B2

(12) United States Patent
Chigusa

(10) Patent No.: US 7,654,300 B2
(45) Date of Patent: Feb. 2, 2010

(54) OBSTACLE DETECTION STOPPING DEVICE OF SOLAR RADIATION SHIELDING APPARATUS

(75) Inventor: Tomomichi Chigusa, Tochigi (JP)

(73) Assignee: Tachikawa Corporation (JP)

( * ) Notice: Subject to any disclaimer, the term of this patent is extended or adjusted under 35 U.S.C. 154(b) by 209 days.

(21) Appl. No.: 10/583,174

(22) PCT Filed: Dec. 17, 2004

(86) PCT No.: PCT/JP2004/018884

§ 371 (c)(1),
(2), (4) Date: Sep. 14, 2006

(87) PCT Pub. No.: WO2005/059291

PCT Pub. Date: Jun. 30, 2005

(65) Prior Publication Data

US 2007/0144685 A1 Jun. 28, 2007

(30) Foreign Application Priority Data

Dec. 18, 2003 (JP) ..... 2003-421401

(51) Int. Cl.
*E06B 9/30* (2006.01)

(52) U.S. Cl. ..... 160/170; 160/300

(58) Field of Classification Search ..... 160/170, 160/171, 300, 304.1, 291, 292, 303
See application file for complete search history.

(56) References Cited

U.S. PATENT DOCUMENTS 2,701,611 A * 2/1955 Griesser ..... 160/170
2,758,644 A * 8/1956 Virlouvet ..... 160/170
5,123,472 A * 6/1992 Nagashima et al. ..... 160/170

(Continued)

FOREIGN PATENT DOCUMENTS

JP 04-095993 U 8/1992

(Continued)

*Primary Examiner*—David Purol
(74) *Attorney, Agent, or Firm*—Harness, Dickey & Pierce, P.L.C.

(57) ABSTRACT

An obstacle detection stopping device of a solar radiation shielding apparatus capable of suppressing the wear of a lifting cord due to the contact of a slat with the lifting cord. The obstacle detection stopping device (10) comprises a support member (11), a rotary drum (13), a cam clutch (12), and a winding pulley (9). A drive shaft (8) is passed through the inside of the device. A rotating force in the unwinding direction is transmitted to the drive shaft (8) by a tension applied to the winding pulley (9). The rotary drum (13) is integrally fitted to the drive shaft (8), and the cam clutch (12) is fitted to the outer edge thereof so as to be rotated relative to each other. Based on the relative rotation of the cam clutch (12) to the rotary drum (13), the cam clutch (12) is moved along its axial direction to change the state of its engagement with a braking projected part (11*g*). The cam clutch (12) is installed so as to be non-rotated relative to the winding pulley (9). When the tension applied to the winding pulley (9) is eliminated, the cam clutch stops its rotating motion together with the winding pulley (9), and based on the relative rotation thereof to the rotary drum (13), the cam clutch is engaged with the braking projected part (11*g*).

8 Claims, 5 Drawing Sheets

U.S. PATENT DOCUMENTS 5,628,356 A * 5/1997 Marocco ..... 160/170
5,906,232 A * 5/1999 Bauer et al. ..... 160/170
5,908,062 A * 6/1999 Fun ..... 160/170
5,996,667 A * 12/1999 Fun ..... 160/84.01
6,012,506 A * 1/2000 Wang et al. ..... 160/170
6,129,131 A * 10/2000 Colson ..... 160/84.02
6,330,899 B1 * 12/2001 Ciuca et al. ..... 160/170
6,588,480 B2 * 7/2003 Anderson ..... 160/170
6,786,270 B2 * 9/2004 Wen et al. ..... 160/170
6,789,598 B2 * 9/2004 Nien ..... 160/172 R
7,178,577 B2 * 2/2007 Liu ..... 160/170
7,287,569 B2 * 10/2007 Lin ..... 160/170
2006/0037720 A1 * 2/2006 Huang ..... 160/171

FOREIGN PATENT DOCUMENTS

JP 5-141162 A 6/1993

* cited by examiner

OBSTACLE DETECTION STOPPING DEVICE OF SOLAR RADIATION SHIELDING APPARATUS

TECHNICAL FIELD

The present invention relates to an obstacle detection stopping device of a solar radiation shielding apparatus.

BACKGROUND ART

In a conventional technique, a horizontal type blind is provided with an obstacle detection stopping device which stops unwinding of a lifting cord to stop lowering of slats and a bottom rail when the bottom rail collides with an obstacle during lowering of the slats; and such an obstacle detection stopping device of a solar radiation shielding apparatus has been disclosed many times. Such obstacle detection stopping device includes a collision detection means which detects that a bottom rail collides with an obstacle and a lowering stopping means which stops unwinding of a lifting cord on the basis of collision of the obstacle with a bottom rail.

An obstacle detection stopping device of a solar radiation shielding apparatus disclosed in a patent document 1 includes springs and a stop ring as a collision detection means; and gears as a lowering stopping means. The collision detection means detects collision with a bottom rail and an obstacle on the basis of slack of a lifting cord; and the lowering stopping means stops lowering of slats and the bottom rail on the basis of the slack of the lifting cord. More specifically, the stop ring is penetrated by the lifting cord and biased by the springs toward the gear direction; and the stop ring moves toward the gear direction by biasing force of the springs so as to be engaged with the gears when the slack is generated in the lifting cord. Then, it is configured that the stop ring is engaged with the gears, whereby unwinding of the lifting cord can be stopped; and the stop ring is engaged with the gears, whereby the lowering of the bottom rail is stopped.

Patent document 1: Japanese Registered Utility Model No. 2546419

DISCLOSURE OF THE INVENTION

Problems to be Solved by the Invention

However, in the obstacle detection stopping device of the solar radiation shielding apparatus described in the patent document 1, when the slack of the lifting cord is detected, the lifting cord is led in the horizontal direction; and therefore, there is a case that the lifting cord sways in that direction. In such a case, the lifting cord comes in contact with the slats and therefore wear of the lifting cord is likely to be speeded up.

Furthermore, in the obstacle detection stopping device of the solar radiation shielding apparatus described in the patent document 1, the stop ring needs to be arranged radially outside a roll-up drum in order to detect the slack of the lifting cord. Therefore, there is a problem in that the stop ring protrudes radially outside the roll-up drum and a head box for accommodating the roll-up drum and the stop ring becomes larger.

The present invention is implemented to solve the foregoing problem, and a first object of the present invention is to provide an obstacle detection stopping device of a solar radiation shielding apparatus capable of suppressing wear of a lifting cord due to contact of slats with the lifting cord. Furthermore, a second object of the present invention is to provide an obstacle detection stopping device of a solar radiation shielding apparatus capable of reducing in size of a head box.

Means for Solving Problem

To attain the aforementioned object, according to first aspect of the present invention, there is provided an obstacle detection stopping device of a solar radiation shielding apparatus, which rotatably supports a winding pulley; supports a solar radiation shielding member by a lifting cord supported by the winding pulley; enables the solar radiation shielding member to be led in by rotation driving the winding pulley in a rolling-up direction of the lifting cord with a driving shaft rotated by an operating means; enables the solar radiation shielding member to perform lead-out operation by rotating the winding pulley in an unwinding direction of the lifting cord by a tension exerted on the lifting cord on the basis of operation of the operating means; and stops the lead-out operation by detecting an obstacle coming into contact with the solar radiation shielding member in the lead-out operation of the solar radiation shielding member, the obstacle detection stopping device comprising: an obstacle detection means which blocks rotation of the winding pulley that supports the lifting cord when a tension in a lead-out direction is not exerted to the lifting cord; and a stopping means which blocks rotation of the driving shaft on the basis of rotation relative to the winding pulley in which rotation is blocked on the basis of function of the obstacle detection means and the driving shaft.

According to second aspect of the present invention, in the present invention according to the first aspect, the obstacle detection means is configured by a friction generating means formed between the winding pulley and a supporting member which rotatably supports the winding pulley.

According to third aspect of the present invention, in the present invention according to first aspect, the stopping means includes a cam mechanism in which the stopping means becomes an engagement state or a disengagement state with a supporting member which rotatably supports the winding pulley on the basis of rotation relative to the winding pulley and the driving shaft.

According to fourth aspect of the present invention, in the present invention according to any one of first to third aspects, the stopping means includes: a first stopping means formed nonrotatably relative to the winding pulley and movably relative thereto along an axial direction and having a sliding hole inclined with respect to an axis line of the winding pulley; a second stopping means formed rotatably relative to the first stopping means within a predetermined range and movable relative thereto in the axial direction by including a sliding projected part nonmovable relative to the winding pulley and sliding inside the sliding hole; and a third stopping means which engages with the first stopping means and stops rotation of the first stopping means, in which the first stopping means moves in the axial direction by the rotation relative to the second stopping means and stops the rotation by engaging with the third stopping means; and the second stopping means stops the rotation of the driving shaft by engagement between a controlling projected part provided in the second stopping means on the basis of the rotation stop of the first stopping means and an engaging projected part formed in the winding pulley and formed engageably with the controlling projected part.

According to fifth aspect of the present invention, in the present invention according to fourth aspect, the first stopping means is configured to arrange a plurality of braking claws, which engages with the third stopping means, formed at even angles along a circumferential direction.

According to sixth aspect of the present invention, in the present invention according to any one of first to third aspects, the stopping means is provided at only two winding pulleys arranged on both sides of the driving shaft.

Effect of the Invention

According to the present invention, there can be provided an obstacle detection stopping device of a solar radiation shielding apparatus capable of suppressing wear of a lifting cord due to contact of slats with the lifting cord.

DESCRIPTION OF THE REFERENCE NUMERALS

Figure 1:
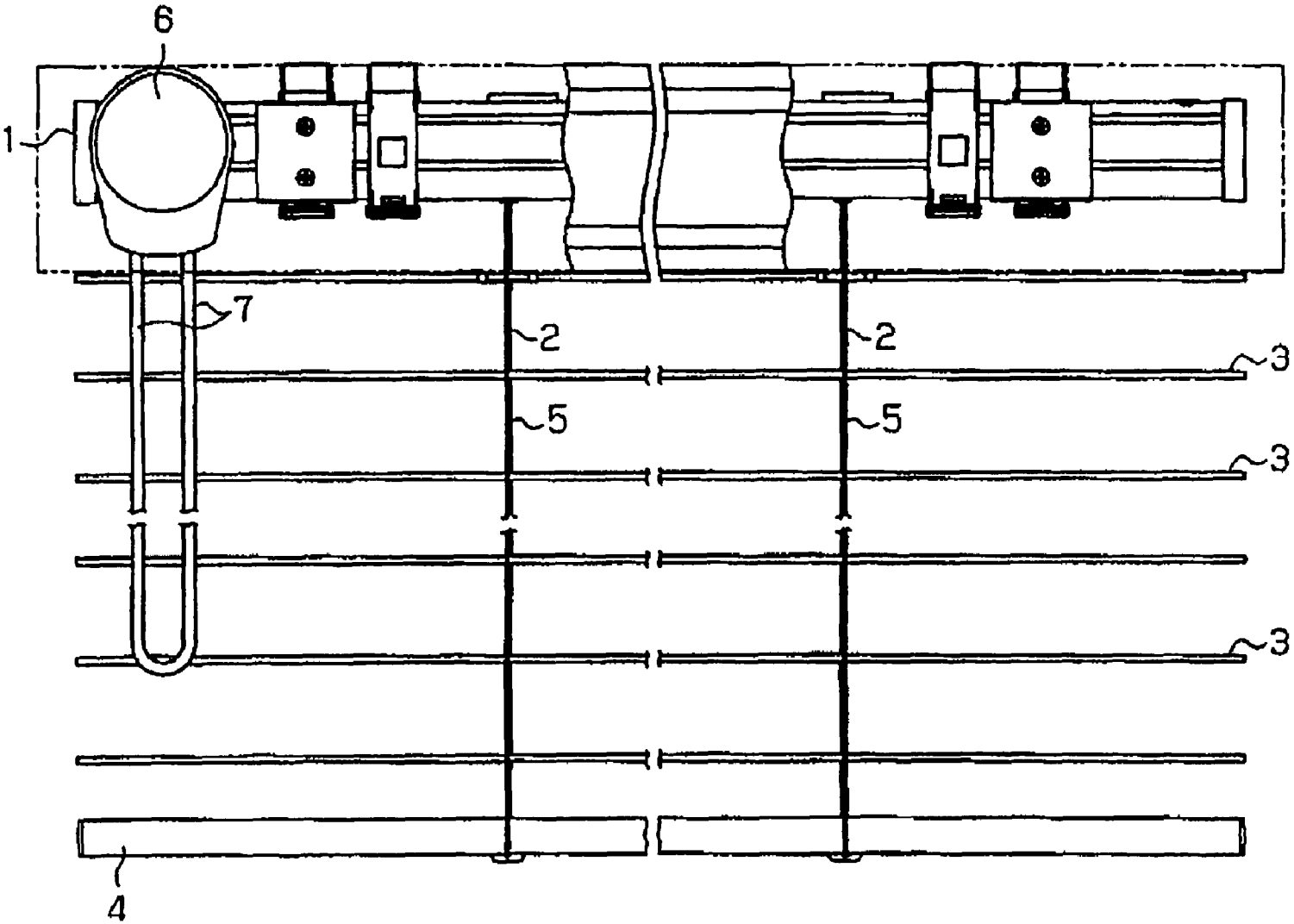
FIG. 1 is a schematic view of a horizontal type blind.

3 . . . slat as solar radiation shielding member
5 . . . lifting cord
6 . . . operating device as operating means
8 . . . driving shaft
9 . . . winding pulley
9*c* and 9*d* . . . engaging projected part
11 . . . supporting member
11*g* . . . braking projected part as third stopping means
11*i* . . . coating part as friction generating means
12 . . . cam clutch as first stopping means
12*c* . . . braking claw
12*d* . . . sliding hole
13 . . . rotary drum as second stopping means
13*e* . . . controlling projected part

BEST MODE FOR CARRYING OUT THE INVENTION

An embodiment embodied with the present invention will be described below with reference to FIG. 1 to FIG. 6. In a horizontal type blind as a solar radiation shielding apparatus shown in FIG. 1, many number of slats 3 as a solar radiation shielding member are suspended and supported via a plurality of ladder cords 2 hung from a head box 1; and a bottom rail 4 is suspended and supported at a lower end of the ladder cords 2.

A plurality of lifting cords 5 hung from the head box 1 pass through the slats 3 in the vicinity of the ladder cords 2. The lifting cord 5 has its upper end wound around a winding pulley 9 (refer to FIG. 2) disposed in a head box 1 and its lower end connected to the bottom rail 4.

The lifting cord 5 performs rolling-up or unwinding on the basis of rotation of the winding pulley 9 and moves up and down the bottom rail 4 and the slats 3 on the basis of the rotation. Furthermore, angle adjustment of each of the slats 3 is performed in the same phase via the ladder cords 2 on the basis of the rotation of the winding pulley 9. In addition, it is configured so that the slats 3 are not further pivoted when the each slat 3 is pivoted to a substantially vertical direction.

An operating device 6 as an operating means is provided at one end of the head box 1 and an operating cord 7 is hung from the operating device 6. The operating device 6 can rotatably drive a driving shaft 8 (refer to FIG. 2), which is accommodated in the head box 1, on the basis of operation of the operating cord 7; and the winding pulley 9 is rotated by the rotation of the driving shaft 8.

The operating device 6 includes a self-weight drop prevention device, not shown in the drawing, inside thereof. When raising operation of the bottom rail 4 and the slats 3 based on the operating cord 7 is stopped, the self-weight drop prevention device is operated to stop the rotation of the driving shaft 8, so that the bottom rail 4 and the slats 3 are suspended and supported at a desired position. Furthermore, if the operation of the self-weight drop prevention device is released by handling of the operating cord 7, the bottom rail 4 and the slats 3 are lowered on the basis of self-weight.

The driving shaft 8 is accommodated in the head box 1 across the longitudinal direction thereof. Obstacle detection stopping devices 10 are arranged at predetermined positions of the driving shaft 8; more specifically, of the lifting cords 5 which suspend and support the bottom rail 4 and the slats 3, each of the obstacle detection stopping devices 10 is arranged in the vicinity of the respective lifting cords 5 located on both sides.

Figure 2:
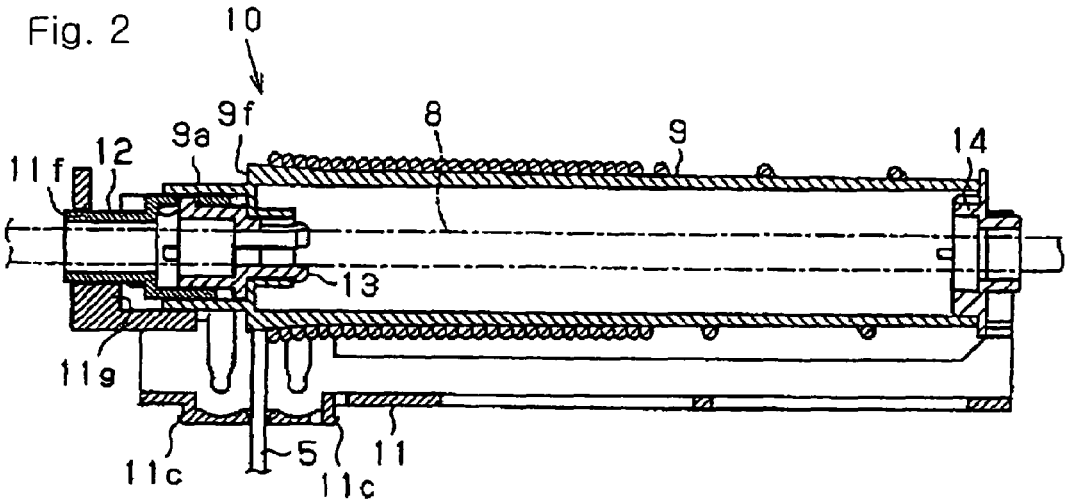
FIG. 2 is a side sectional view of an obstacle detection stopping device.

As shown in FIG. 2, the obstacle detection stopping device 10 includes a supporting member 11, a cam clutch 12 as a first stopping means, a rotary drum 13 as a second stopping means, and the winding pulley 9.

The supporting member 11 is fixed to the head box 1 by means of a snapfit 11*c* close-fitted into a square hole of the head box 1. The supporting member 11 rotatably supports the cam clutch 12, the rotary drum 13, and the winding pulley 9 between penetrating holes 11*f* and 11*l* (refer to FIG. 3(*a*)).

Figure 3:
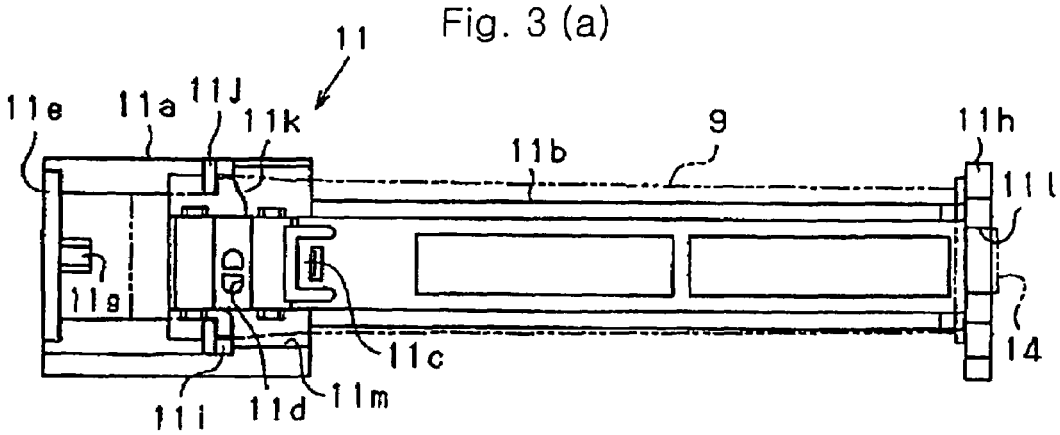
FIGS. 3(*a*) and (*b*) are explanation views of a supporting member.
Figure 3:
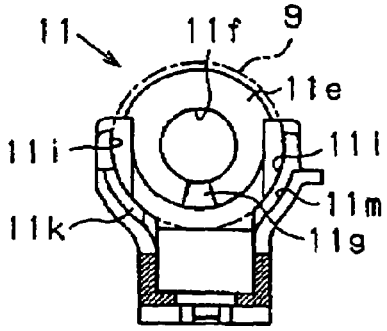

As shown in FIG. 3(*a*) and FIG. 3(*b*), the supporting member 11 includes a first support portion 11*a* almost covering the rotary drum 13 and the cam clutch 12; and a second support portion 11*b* almost covering the winding pulley 9.

The first support portion 11*a* and the second support portion 11*b* are respectively formed with a sandwiching piece 11*j* and a bearing portion 11*h* which hold the winding pulley 9 in sandwiched relation along the axial direction; and the winding pulley 9 is nonmovable in the axial direction.

A leading out opening 11*d* of the lifting cord 5, through which the snapfit 11*c* and the lifting cord 5 are rolled-up or unwound from a predetermined position, and the like are formed in the bottom of the first support portion 11*a*. A guiding portion 11*k* which guides the lifting cord 5 from the leading out opening 11*d* to a predetermined position of the winding pulley 9 at the time of rolling-up of the lifting cord 5 is formed on one side in the width direction of the supporting member 11 (upper side in FIG. 3(*a*)). A supporting portion 11*m* is formed at a position opposite to a guiding portion 11*k*. The guiding portion 11*k* and the supporting portion 11*m* are formed as a gently curved portion. Furthermore, the penetrating hole 11*f* and a braking projected part 11*g* as a third stopping means are formed at a side edge 11*e* of the first support portion 11*a*.

An inner diameter of the penetrating hole 11*f* is formed to be substantially the same as an outer diameter of a cylinder portion 12*a* of the cam clutch 12; and the cylinder portion 12*a* is passed through pivotably relative to the penetrating hole 11*f* and movably in the axial direction. The braking projected part 11*g* is formed under the penetrating hole 11*f* in the first support portion 11*a*. The braking projected part 11*g* is formed by protruding from the side edge 11*e* along the axial direction of the penetrating hole 11*f*.

The first support portion 11*a* includes a coating part 11*i* as an obstacle detection means and a friction generating means, which comes into contact with a winding portion 9*b* of the winding pulley 9 to be described later, from lower side. The coating part 11*i* comes into contact with the winding pulley 9 so that some frictional force is generated with the winding portion 9*b* when the winding pulley 9 rotates. The coating part 11*i* is formed such that an upper end thereof is located upward than the axial center of the winding pulley 9 when the coating part 11*i* is installed with the winding pulley 9 so that the winding pulley 9 does not come off upward of the coating part 11*i* when the winding pulley 9 rotates.

The second support portion 11*b* has a longitudinal length which is formed to be substantially the same as an axial length of the winding portion 9*b* of the winding pulley 9. The bearing portion 11*h* is formed at a longitudinal end (right end in FIG. 3(*a*)) of the second support portion 11*b*. The bearing portion 11*h* is formed to be substantially U-shape and rotatably supports the driving shaft 8 via a pulley cap 14 to be described later.

The winding pulley 9 is rotatably supported to the thus formed supporting member 11 via the cam clutch 12 and the pulley cap 14.

Figure 4:
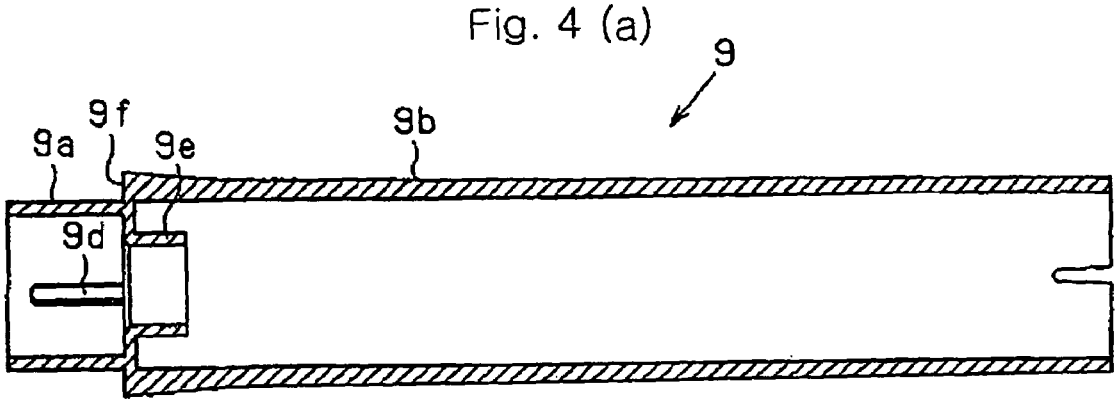
FIGS. 4(*a*) and (*b*) are explanation views of a winding pulley.
Figure 4:
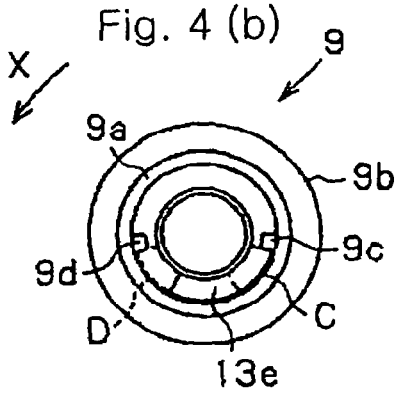

As shown in FIG. 4(*a*) and FIG. 4(*b*), the winding pulley 9 is formed to be substantially cylindrical and includes an engagement portion 9*a* and the winding portion 9*b*.

Engaging projected parts 9*c* and 9*d* protruding toward a radially inner side of the engagement portion 9*a* are formed on an inner circumferential surface of the engagement portion 9*a*. The engaging projected parts 9*c* and 9*d* are formed along an axial direction of the engagement portion 9*a* and arranged approximately 180° to each other in a circumferential direction of the engagement portion 9*a*.

Figure 5:
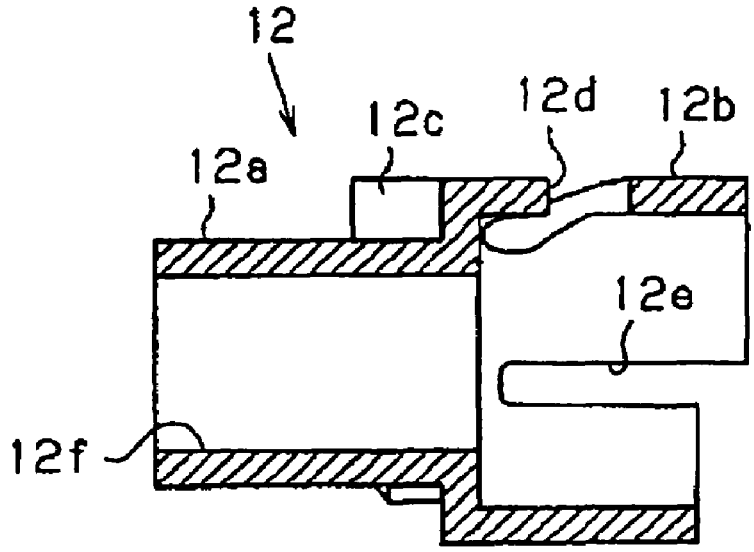
FIGS. 5(*a*) and (*b*) are explanation views of a cam clutch.
Figure 5:
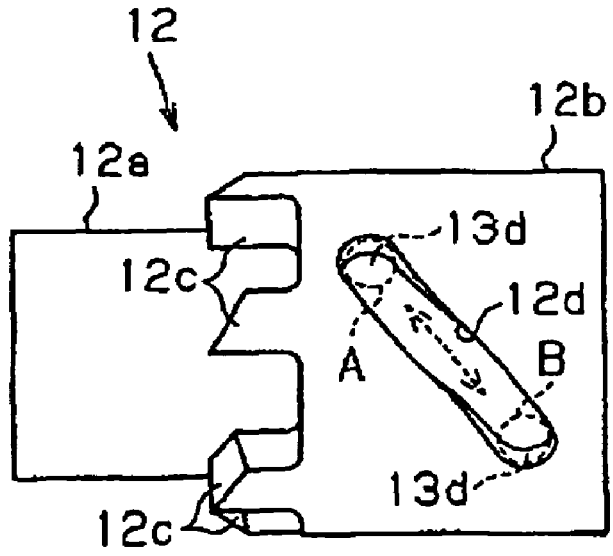

The winding portion 9*b* of the winding pulley 9 is set so as to be gradually small in diameter from a flange portion 9*f* toward an edge side (right side in FIG. 2 and FIG. 5(*a*)). A latching cylinder 9*e* is formed in a radially inner side at an end portion of the leading out opening 11*d* side of the winding portion 9*b*. The latching cylinder 9*e* is extendedly provided toward the edge side along the axis line of the winding portion 9*b*. The substantially disk-shaped pulley cap 14 (refer to FIG. 2) is attached to an end portion of the edge side of the winding portion 9*b*; and the driving shaft 8 is relatively rotatably penetrated to the center of the winding portion 9*b*.

The cam clutch 12 is accommodated in a radially inner side of the engagement portion 9*a* of the winding pulley 9. As shown in FIG. 5(*a*) and FIG. 5(*b*), the cam clutch 12 is formed to be a substantially cylindrical shape and includes the cylinder portion 12*a* and the braking portion 12*b* formed to be larger in diameter than the cylinder portion 12*a*.

The braking portion 12*b* has a diameter of an outer circumferential surface set to be a size being slidable with the inner circumferential surface of the engagement portion 9*a* of the aforementioned winding pulley 9. A braking claw 12*c* is formed at an end of the cylinder portion 12*a* side of the braking portion 12*b* (left side in FIG. 5(*a*) and FIG. 5(*b*)). The braking claw 12*c* is protruded in a serration shape toward the axial direction and engageable with the braking projected part 11*g* of the aforementioned supporting member 11.

The braking claw 12*c* is engaged with the braking projected part 11*g*, thereby preventing the braking claw 12*c* from rotating circumferentially, whereby the supporting member 11 and the cam clutch 12 are nonrotatable relative to each other. A plurality (six 60° spaces in this embodiment) of the braking claws 12*c* are formed at even angles along the circumferential direction of the braking portion 12*b*.

A sliding hole 12*d* and moving slits 12*e* are formed on a side wall of the braking portion 12*b* as a cam mechanism. The sliding hole 12*d* is formed so as to be inclined at approximately 45° with respect to the axis line of the braking portion 12*b*. Furthermore, length of the sliding hole 12*d* is set so as to be arranged across a range of angle approximately 45° in the circumferential direction of the braking portion 12*b*.

The moving slits 12*e* are formed along the axial direction of the braking portion 12*b*. The moving slits 12*e* are arranged so as to correspond to positions of the engaging projected parts 9*c* and 9*d* of the aforementioned winding pulley 9. The moving slits 12*e* and the engaging projected parts 9*c* and 9*d* are engaged, whereby the cam clutch 12 and the winding pulley 9 are installed nonrotatably relative to each other and movable relative to each other along the axial direction.

Therefore, the cam clutch 12 is moved relative to the axial direction of the winding pulley 9, thereby being nonrotatable relative to the supporting member 11 when the braking claw 12*c* is engaged with the braking projected part 11*g*; and, thereby being rotatable relative to the supporting member 11 when the engagement state between the braking claw 12*c* and the braking projected part 11*g* is released.

In the side wall of the braking portion 12*b* in the circumferential direction, one (upside in FIG. 5(*a*)) sandwiching both the moving slits 12*e* is formed so as to protrude farther toward the axial direction than the other (lower side in FIG. 5(*a*)).

As shown in FIG. 2, the rotary drum 13 is accommodated in a radially inner side of the cam clutch 12. Furthermore, the driving shaft 8 penetrates in the cylinder portion 12*a*; however, a cylinder hole 12*f* is larger than a diameter of hexagon axis of the driving shaft 8, thereby being rotatable relative to the driving shaft 8.

Figure 6:
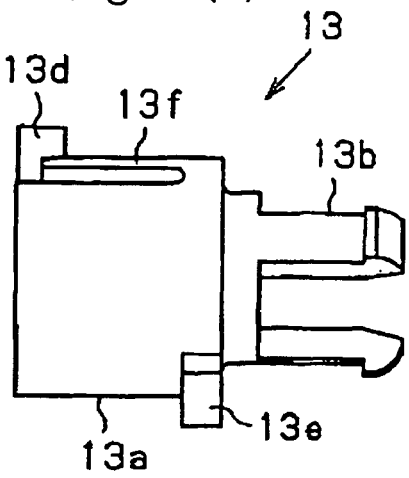
FIGS. 6(*a*), (*b*), and (*c*) are explanation views of a rotary drum.
Figure 6:
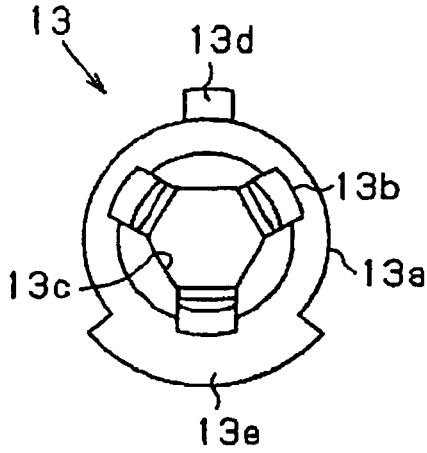
Figure 6:
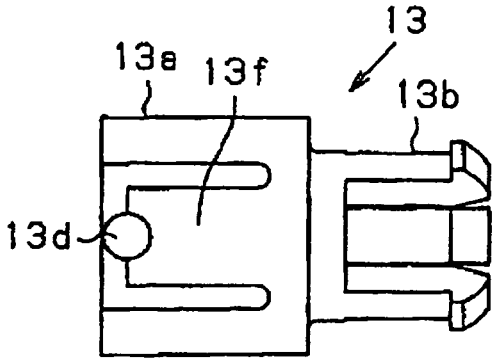

As shown in FIGS. 6(*a*) to (*c*), the rotary drum 13 includes a main body portion 13*a* and latching claws 13*b*. The main body portion 13*a* is formed to be a substantially cylindrical shape and a fixing hole 13*c* being an equilateral hexagon shape is formed at the center thereof. The rotary drum 13 has the driving shaft 8 being hexagon shaped in section having the same size as the fixing hole 13*c* and integrally rotated together with the driving shaft 8.

Three latching claws 13*b* are formed at even spaces (space of 120°) along the circumferential direction of the main body portion 13*a* and elastically deformable toward the center of the latching cylinder 9*e* when being inserted into the latching cylinder 9*e*. The latching claws 13*b* are formed to be a diameter smaller than the main body portion 13*a*; and the latching cylinder 9*e* of the aforementioned winding pulley 9 is sandwiched toward the axial direction by the main body portion 13*a* and the respective claws 13*b* so that the rotary drum 13 and the winding pulley 9 are not moved relative to each other in the axial direction (refer to FIG. 2).

Two cutouts are formed in the main body portion 13*a* along the axial direction and an arm 13*f* is formed by the cutouts. A sliding projected part 13*d* protruding toward outward in the radial direction of the rotary drum 13 is formed in an edge of the arm 13*f*. The arm 13*f* has flexibility along the radial direction of the rotary drum 13 by the cutouts so that the edge distorts toward the center together with the sliding projected part 13*d* when being installed inside the cam clutch 12. The sliding projected part 13*d* is formed by protruding in a substantially cylinder shape and slidably formed in the sliding hole 12*d* of the aforementioned cam clutch 12.

A controlling projected part 13*e* protruding toward radially outwardly is formed on one end (right end in FIG. 6(*a*) and FIG. 6(*c*)) on the latching claw 13*b* side of the main body portion 13*a*. The controlling projected part 13*e* is arranged at a position substantially opposite to the aforementioned sliding projected part 13*d* in the circumferential direction of the main body portion 13*a*. Furthermore, the controlling projected part 13*e* is formed by protruding in a predetermined angle range in the circumferential direction of the main body portion 13*a*; and an amount of protrusion thereof is set so as to come into contact with the engaging projected parts 9*c* and 9*d* in the circumferential direction when the rotary drum 13 is rotated relative to the winding pulley 9.

The thus formed rotary drum 13 is installed so that the sliding projected part 13*d* is accommodated inside the sliding hole 12*d* of the cam clutch 12. Therefore, as shown in FIG. 5(*b*), the rotary drum 13 and the cam clutch 12 are movable relative to each other only in the range where the sliding projected part 13*d* is moved relative to the inside of the sliding hole 12*d*.

Specifically, when the sliding projected part 13*d* is located at A, the cam clutch 12 is placed at the nearest side of the winding pulley 9 (right side in FIG. 2), whereby the engagement state between the braking claw 12*c* and the braking projected part 11*g* is released. Meanwhile, when the sliding projected part 13*d* is located at B, the cam clutch 12 is placed at the farthest side of the winding pulley 9 (left side in FIG. 2), whereby the braking claw 12*c* and the braking projected part 11*g* become the engagement state.

Furthermore, the rotary drum 13 is installed so that the controlling projected part 13*e* is arranged between the engaging projected parts 9*c* and 9*d* of the winding pulley 9. Therefore, as shown in FIG. 4(*b*), the rotary drum and the winding pulley 9 are movable relative to each other only in the range where the controlling projected part 13*e* is moved relative to between the engaging projected parts 9*c* and 9*d* of the winding pulley 9. The range where the controlling projected part 13*e* is moved relative to between the engaging projected parts 9*c* and 9*d* is set to be substantially the same as the range where the sliding projected part 13*d* is moved relative to the inside of the sliding hole 12*d*. That is, the controlling projected part 13*e* is rotatable relative to the engaging projected parts 9*c* and 9*d* in the range of approximately 45°.

Specifically, the sliding projected part 13*d* is placed at A (refer to FIG. 5(*b*)) when the controlling projected part 13*e* is located at C; and the sliding projected part 13*d* is placed at B (refer to FIG. 5(*b*)) when the controlling projected part 13*e* is located at D (refer to FIG. 4(*b*)).

Next, function of the thus configured horizontal type blind will be described. First, operation in raising the horizontal type blind will be described. When the operating cord 7 is operated to rotate the driving shaft 8 in a raising direction of the horizontal type blind, the rotation is transmitted to the rotary drum 13 to rotate the rotary drum 13 in X direction shown in FIG. 4. Consequently, the rotary drum 13 is rotated relative to the winding pulley 9 and the cam clutch 12 till the sliding projected part 13*d* moves to A and the controlling projected part 13*e* moves to C.

Consequently, the cam clutch 12 is moved toward the right direction in FIG. 2 to release the engagement state between the braking claw 12*c* of the cam clutch 12 and the braking projected part 11*g* of the supporting member 11, whereby the cam clutch 12 becomes rotatable relative to the supporting member 11.

Then, the rotary drum 13 is nonrotatable relative to the cam clutch 12 and the winding pulley 9 any more. Therefore, when the driving shaft 8 is further rotated in the raising direction, the rotary drum 13 is rotated in the raising direction integrally with the cam clutch 12 and the winding pulley 9 to perform the raising operation of the horizontal type blind.

Next, operation in lowering the horizontal type blind will be described. The operation in lowering the horizontal type blind is performed using self-weight of the slats 3 and the bottom rail 4 and therefore driving force in lowering is transmitted from the winding pulley 9 toward the driving shaft 8.

When the winding pulley 9 and the cam clutch 12 are rotated in a lowering direction, the rotary drum 13 is such that the sliding projected part 13*d* located at A (refer to FIG. 5(*b*)) is received by a force exerted from the sliding hole 12*d* toward a lower side shown in the drawing; and the controlling projected part 13*e* located at C (refer to FIG. 4(*b*)) is received by a force exerted from the engaging projected part 9*c* toward a clockwise direction shown in the drawing. Therefore, when the winding pulley 9 and the cam clutch 12 are rotated toward the lowering direction, the rotation toward the lowering direction is instantaneously transmitted to the rotary drum 13 and the driving shaft 8.

While the lowering operation of the horizontal type blind is performed, when the bottom rail 4 collides with an obstacle, the bottom rail 4 inclines toward the center of gravity side at a position collided with the obstacle as a supporting point. That is, of the obstacle detection stopping devices 10 arranged at both ends of the driving shaft 8, self-weight of mainly the slats 3 and the bottom rail 4 is applied to one obstacle detection stopping device 10 situated opposite to the supporting point with respect to the center of gravity.

Therefore, in the other obstacle detection stopping device 10 to which the self-weight of the slats 3 and the bottom rail 4 is not applied, rotation of the winding pulley 9 is stopped by friction between the coating part 11*i* and the outer circumferential surface of the base end side (left side in FIG. 2 and FIG. 5(*a*)) of the winding portion 9*b*; and with the stop, transmission of a rotating force from the winding pulley 9 and the cam clutch 12 to the rotary drum 13 and the driving shaft 8 is stopped.

At this time, unwinding of the lifting cord 5 by the obstacle detection stopping device 10 to which the self-weight of the slats 3 and the bottom rail 4 is not applied, is stopped on the basis of stop of the rotation of the winding pulley 9; and therefore, the lifting cord 5 does not sway in the horizontal direction.

Meanwhile, in the obstacle detection stopping device 10 situated opposite to the supporting point with respect to the center of gravity, unwinding of the lifting cord 5 is continuously performed by the self-weight of the slats 3 and the bottom rail 4, irrespective of the rotation state of the obstacle detection stopping device 10 situated on the supporting point side with respect to the center of gravity. Therefore, the rotary drum 13 and the driving shaft 8 are also rotated in the lowering direction via the winding pulley 9 and the cam clutch 12.

At this time, in the obstacle detection stopping devices 10 attached at positions in the vicinity of both ends in the longitudinal direction (horizontal direction in FIG. 1) of the horizontal type blind, one winding pulley 9 becomes a stop state and the other winding pulley 9 becomes a rotation state; however, both are penetrated by one driving shaft 8 and therefore rotation is transmitted to the driving shaft 8 by the winding pulley 9 in the rotation state.

Therefore, in the obstacle detection stopping device 10 in which rotation of the winding pulley 9 is stopped, the winding pulley 9 and the cam clutch 12 do not rotate; on the other hand, only the rotary drum 13 is rotated in the lowering direction. As the result, the winding pulley 9 and the cam clutch 12 and the rotary drum 13 are rotated relative to each other, whereby the sliding projected part 13*d* formed in the rotary drum 13 moves from A to B in the sliding hole 12*d* and the controlling projected part 13*e* moves from C to D between the engaging projected parts 9*c* and 9*d* of the winding pulley 9.

Thus, when the sliding projected part 13*d* is located at B and the controlling projected part 13*e* is located at D, the braking claw 12*c* of the cam clutch 12 and the braking projected part 11*g* of the supporting member 11 are in an engagement state and therefore the cam clutch 12 becomes nonrotatable relative to the supporting member 11. As the result, the sliding projected part 13*d* moved to B in the sliding hole 12*d* cannot be further moved downward in FIG. 5(*b*) and consequently its rotating motion is stopped.

On the other hand, in the obstacle detection stopping device 10 in which the winding pulley 9 is rotated by the self-weight of the slats 3 and the bottom rail 4, the sliding projected part 13*d* is located at A in the sliding hole 12*d* and it becomes in a state (state located at C in FIG. 4) where the engaging projected part 9*c* comes into contact with the controlling projected part 13*e*. Therefore, when rotation of the driving shaft 8 and the rotary drum 13 is stopped, the cam clutch 12 cannot move the sliding hole 12*d* toward lower side shown in FIG. 5(*b*) and the winding pulley 9 cannot pivot the controlling projected part 13*e* in a clockwise direction. Therefore, upon stopping the driving shaft 8, pivotal movement toward the lowering direction by the self-weight of the slats 3 and the bottom rail 4 is stopped.

In this case, unwinding of the lifting cord 5 by the obstacle detection stopping device 10 in which the winding pulley 9 is rotated by the self-weight of the slats 3 and the bottom rail 4 is also stopped on the basis of stop of rotation of the winding pulley 9 and therefore the lifting cord 5 does not sway in the horizontal direction.

In addition, as described above, the braking claws 12*c* and the braking projected parts 11*g* in either one of the obstacle detection stopping devices 10 arranged on both sides of the horizontal type blind are in an engagement state, after that, lowering operation of the slats 3 and the bottom rail 4 is disabled till the engagement state between the braking claw 12*c* and the braking projected part 11*g* is released. In such a case, the operating cord 7 is operated to rotate the driving shaft 8 in a raising direction once and the engagement between the braking claw 12*c* and the braking projected part 11*g* is released, whereby lowering operation of the slats 3 and the bottom rail 4 is possible again.

As described above, according to this embodiment, the following effects can be exhibited. (1) When the bottom rail 4 collides with an obstacle in lowering operation of the slats 3 and the bottom rail 4, the obstacle detection stopping device 10 stops rotation of the winding pulley 9 so that unwinding of the lifting cord 5 is not performed. Therefore, after the bottom rail 4 collides with an obstacle, slack is not generated in the lifting cord 5 and generation of twine in the lifting cord 5 can be prevented.

(2) The obstacle detection stopping device 10 stops unwinding of the lifting cord 5 by stopping the rotation of the winding pulley 9 itself and therefore the lifting cord 5 does not sway in the horizontal direction with the stopping operation. Therefore, the lifting cord 5 does not come in contact with the slats 3 in stopping the unwinding of the lifting cord 5 and consequently wear of the lifting cord 5 can be suppressed.

(3) In stopping the rotation of the driving shaft 8, the braking claw 12*c* of the cam clutch 12 is engaged with the braking projected part 11*g* of the supporting member 11 on the basis of the rotation of the driving shaft 8, whereby lowering operation of the horizontal type blind can be stopped on the axis line of the winding pulley 9. Therefore, a mechanism for detecting collision between the bottom rail 4 and an obstacle and a mechanism for stopping the lowering operation of the horizontal type blind are not required to protrude outward in the radial direction of the winding pulley 9. Therefore, the head box 1 can be reduced in size.

(4) A plurality (six 60° spaces in this embodiment) of the braking claws 12*c* are formed at even angles along the circumferential direction of the braking portion 12*b*. Therefore, when the bottom rail 4 collides with an obstacle, the braking claw 12*c* moves toward the braking projected part 11*g* formed on the supporting member 11; however, the braking claw 12*c* can engage with the braking projected part 11*g* instantaneously (before rotating 60°). Therefore, when the bottom rail 4 collides with an obstacle, the lowering operation of the horizontal type blind can be rapidly stopped.

(5) In the supporting member 11, the coating parts 11*i* come into contact with the winding portion 9*b* of the winding pulley 9 from both lower sides to generate some frictional force between the winding pulley 9 and the coating parts 11*i*. Therefore, when the bottom rail 4 collides with an obstacle, the rotation of the winding pulley 9 is instantaneously stopped, whereby generation of slack in the lifting cord 5 and generation of twine in the lifting cord 5 with the generation of the slack in the lifting cord 5 can be suppressed.

In addition, the above-mentioned embodiment may be implemented in the following embodiment.

In the above-mentioned embodiment, the sliding hole 12*d* is formed so as to be inclined at approximately 45° with respect to the axis line of the braking portion 12*b*. However, the inclined angle of the sliding hole 12*d* may be appropriately changed. Furthermore, movement speed toward the axial direction of the cam clutch 12 can be adjusted by changing the inclined angle of the sliding hole 12*d*.

In the above-mentioned embodiment, the coating parts 11*i* come into contact with the winding portion 9*b* of the winding pulley 9 from the lower sides to generate the frictional force between the winding pulley 9 and the coating part 11*i*. However, it may be such that a means which generates a force to block rotating motion of the winding pulley 9 is provided; for example, it may be configured to generate a force to block the rotating motion of the winding pulley 9 using clutch springs, friction disks, magnets or the like.

Furthermore, it may be configured to generate a force to block the rotating motion of the winding pulley 9 by means of sandwiching the flange portion 9*f* of the winding pulley 9 and the pulley cap 14 with the supporting member 11 by narrowing spacing between the bearing portion 11*h* and the sandwiching piece 11*j*.

Further, it may be configured to generate a force to block the rotating motion of the winding pulley 9 by means of bringing the guiding portion 11*k* and the supporting portion 11*m* into contact with the lifting cord 5 wound around the winding pulley 9 by reducing diameters of the guiding portion 11*k* and the supporting portion 11*m*.

In the above-mentioned embodiment, the solar radiation shielding apparatus is a horizontal type blind and the obstacle detection stopping device 10 is arranged in the horizontal type blind; however, it may be such that the solar radiation shielding apparatus includes the bottom rail and the lifting cord. Therefore, the solar radiation shielding apparatus may be a pleated curtain.

Furthermore, the solar radiation shielding apparatus may be a rolled up curtain by using a spindle in place of the bottom rail.

In the above-mentioned embodiment, the obstacle detection stopping devices 10 are arranged in the winding pulleys 9 which wind the lifting cords 5 hung from positions in the vicinity of both ends in the longitudinal direction (horizontal direction in FIG. 1) of the horizontal type blind. However, the obstacle detection stopping device 10 may be arranged in all winding pulleys 9 which wind the lifting cords 5.

In the above-mentioned embodiment, lowering operation of the horizontal type blind is performed using self-weight of the slats 3 and the bottom rail 4. However, it may not be such that the lowering operation of the horizontal type blind is performed on the basis of self-weight of the slats and the bottom rail; for example, it may be configured to perform the lowering operation of the horizontal type blind on the basis of a tension means which always tenses the solar radiation shielding member toward the lowering direction. In addition, arrangement of the bottom rail can be eliminated by means of this configuration;

Furthermore, a lead-in or lead-out direction of the solar radiation shielding member can be changed by means of the tension means. Therefore, for example, it may be configured to include the obstacle detection stopping device in the solar radiation shielding apparatus in which the solar radiation shielding member is led in or led out in the horizontal direction.

In the above-mentioned embodiment, the driving shaft 8 is rotated in the unwinding direction by self-weight of the slats 3 and the bottom rail 4. However, the driving shaft 8 may be configured to be directly rotated in the unwinding direction with the operating cord 7. According to this configuration, engagement between the braking projected part 11*g* and the braking claw 12*c* can be directly performed by operation of the operating cord 7 and therefore the obstacle detection stopping device 10 can be configured by including at least one each of the lifting cord 5 and winding pulley 9. Furthermore, the rotation of the winding pulley 9 can be stopped without inclining the bottom rail 4.

The invention claimed is:

1. A solar radiation shielding apparatus including an obstacle detection stopping device for stopping an extension of a solar radiation shielding member after an obstacle contacts said solar radiation shielding member, the apparatus comprising:

a rotatable winding pulley;

a supporting member rotatably supporting said winding pulley;

a lifting cord supported by said winding pulley;

said solar radiation shielding member supported by said lifting cord;

a rotatable driving shaft selectively rotatably driving said winding pulley in a rolling-up direction of the lifting cord to retract said solar radiation shielding member, said winding pulley being rotatable in an unwinding direction of the lifting cord by a tension exerted on said lifting cord to extend said solar radiation shielding member; and said obstacle detection stopping device which includes:

an obstacle detector frictionally engaging said winding pulley and adapted to stop rotation of said driving pulley after the tension exerted on said lifting cord is interrupted; and a stop operably engageable with said driving shaft and adapted to stop rotation of said driving shaft relative to said winding pulley which is stopped by said obstacle detector;

said stop comprising:

a clutch which is selectively movable in a direction of the axis line of said winding pulley;

a rotary drum which is fixed against movement in the direction of the axis line of said winding pulley and is rotatable with the driving shaft; and a braking projected part formed on said supporting member so as to be engageable with said clutch, wherein said clutch is inserted into a penetrating hole formed in said supporting member so that a cylinder portion formed at an edge of said clutch is relatively rotatable and movable in the direction of the axis line, and obstructs the rotation of said driving shaft by letting the rotation of the rotary drum stop in response to becoming impossible to rotate, by moving in the direction of the axis line of said winding pulley according to rotation of said driving shaft relative to said winding pulley and engaging with said braking projected part of said supporting member.

2. A solar radiation shielding apparatus including an obstacle detection stopping device for stopping an extension of a solar radiation shielding member after an obstacle contacts said solar radiation shielding member, the apparatus comprising:

a rotatable winding pulley;

a supporting member rotatably supporting said winding pulley;

a lifting cord supported by said winding pulley;

said solar radiation shielding member supported by said lifting cord;

a rotatable driving shaft selectively rotatably driving said winding pulley in a rolling-up direction of the lifting cord to retract said solar radiation shielding member, said winding pulley being rotatable in an unwinding direction of the lifting cord by a tension exerted on said lifting cord to extend said solar radiation shielding member; and said obstacle detection stopping device which includes:

an obstacle detector frictionally engaging said winding pulley and adapted to stop rotation of said winding pulley after the tension exerted on said lifting cord is interrupted; and a stop operably engageable with said driving shaft and adapted to stop rotation of said driving shaft relative to said winding pulley which is stopped by said obstacle detector;

said stop comprising:

a clutch that has a braking claw which is selectively movable in a direction of the axis line of said winding pulley;

a rotary drum which is fixed against movement in the direction of the axis line of said winding pulley and is rotatable with the driving shaft; and a braking projected part formed on said supporting member so as to be engageable with said braking claw of said clutch, wherein said clutch is inserted into a penetrating hole formed in said supporting member so that a cylinder portion formed at an edge of said clutch is relatively rotatable and movable in the direction of the axis line, and obstructs the rotation of said driving shaft by letting the rotation of the rotary drum stop in response to becoming impossible to rotate, by moving in the direction of the axis line of said winding pulley according to rotation of said driving shaft relative to said winding pulley and said braking claw engaging with said braking projected part of said supporting member.

3. The apparatus according to claim 1, wherein said stop includes a cam mechanism that moves said clutch in the direction of the axis line of said winding pulley according to rotation of said driving shaft relative to said winding pulley.

4. The apparatus according to claim 2, wherein said stop includes a cam mechanism that moves said braking claw in the direction of the axis line of said winding pulley to engage with said supporting member according to rotation of said driving shaft relative to said winding pulley.

5. The apparatus according to one of claims 1 to 4, wherein said obstacle detector further comprises a friction generator disposed between said winding pulley and a supporting member rotatably supporting said winding pulley.

6. A solar radiation shielding apparatus including an obstacle detection stopping device for stopping an extension of a solar radiation shielding member after an obstacle contacts said solar radiation shielding member, the apparatus comprising:

a rotatable winding pulley;

a lifting cord supported by said winding pulley;

said solar radiation shielding member supported by said lifting cord;

a rotatable driving shaft selectively rotatably driving said winding pulley in a rolling-up direction of the lifting cord to retract said solar radiation shielding member, said winding pulley being rotatable in an unwinding direction of the lifting cord by a tension exerted on said lifting cord to extend said solar radiation shielding member; and said obstacle detection stopping device which includes:

an obstacle detector frictionally engaging said winding pulley and adapted to stop rotation of said driving pulley after the tension exerted on said lifting cord is interrupted; and a stop operably engageable with said driving shaft and adapted to stop rotation of said driving shaft relative to said winding pulley which is stopped by said obstacle detector;

said stop comprising:

a clutch mounted along said driving shaft so as to be axially movable but nonrotatable relative to said winding pulley, said clutch having a sliding hole that is inclined with respect to said winding pulley;

a rotary drum mounted along said driving shaft so as to be rotatable within a predetermined range, to be axially movable relative to said clutch, and to be rotatable with the driving shaft, said rotary drum including a sliding projected part that is slideable inside said sliding hole but nonmovable relative to said winding pulley; and a braking projected part mounted along said driving shaft and engageable with said clutch to stop rotation of said clutch, wherein said clutch moves axially along said driving shaft in response to rotation relative to said rotary drum and stops the rotation by engaging said braking projected part; and said rotary drum includes a controlling projected part to stop rotation of said clutch that selectively engages an engaging projected part of said winding pulley to stop rotation of said driving shaft.

7. The apparatus according to claim 6, wherein said clutch includes a plurality of braking claws evenly disposed along a circumferential direction of said clutch, the plurality of braking claws being selectively engageable with said braking projected part.

8. The apparatus according to one of claims 1, 2, 3, 4, 5 and 6, wherein said stop is provided at only two locations along said driving shaft.

* * * * *

UNITED STATES PATENT AND TRADEMARK OFFICE

CERTIFICATE OF CORRECTION

PATENT NO. : 7,654,300 B2
APPLICATION NO. : 10/583174
DATED : February 2, 2010
INVENTOR(S) : Tomomichi Chigusa It is certified that error appears in the above-identified patent and that said Letters Patent is hereby corrected as shown below:

Column 14, Lines 35-36, Claim 8, "claims 1, 2, 3, 4, 5 and 6," should be claims 1, 2, 3, 4, 6 and 7,--

Signed and Sealed this
Twenty-second Day of March, 2011

David J. Kappos

David J. Kappos
*Director of the United States Patent and Trademark Office*